US009493012B2

(12) United States Patent
Fukui

(10) Patent No.: US 9,493,012 B2
(45) Date of Patent: Nov. 15, 2016

(54) APPARATUS FOR AND METHOD OF EJECTING DROPLETS

(71) Applicant: SCREEN HOLDINGS CO., LTD., Kyoto (JP)

(72) Inventor: Tamio Fukui, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 14/634,668

(22) Filed: Feb. 27, 2015

(65) Prior Publication Data

US 2015/0251437 A1 Sep. 10, 2015

(30) Foreign Application Priority Data

Mar. 7, 2014 (JP) ..... 2014-044840

(51) Int. Cl.
*B41J 2/165* (2006.01)
*B41J 2/175* (2006.01)

(52) U.S. Cl.
CPC ..... *B41J 2/17566* (2013.01); *B41J 2/16508* (2013.01); *B41J 2/16526* (2013.01); *B41J 2/16585* (2013.01); *B41J 2/16588* (2013.01); *B41J 2002/1657* (2013.01)

(58) Field of Classification Search
CPC ..... B41J 2/16526
USPC ..... 347/23, 35, 36, 22, 33
See application file for complete search history.

(56) References Cited

U.S. PATENT DOCUMENTS 6,224,188 B1 * 5/2001 Suzuki ..... B41J 2/04573 347/35
6,739,693 B1 5/2004 Ferringer
2009/0051719 A1 2/2009 Kuwahara et al.
2011/0227980 A1 9/2011 Saitoh et al.

FOREIGN PATENT DOCUMENTS

JP 2012-161917 A 8/2012

OTHER PUBLICATIONS

Extended European Search Report issued in European Patent Application No. 15154453.3, dated Feb. 5, 2016.

* cited by examiner

*Primary Examiner* — Lam Nguyen
(74) *Attorney, Agent, or Firm* — McDermott Will & Emery LLP

(57) ABSTRACT

A droplet ejecting apparatus includes a liquid filling chamber filled with a liquid, and a plurality of pressure chambers in communication with the liquid filling chamber and filled with the liquid. Each of the pressure chambers includes a communication port in communication with the liquid filling chamber, a pressure generating element for exerting pressure on the liquid which fills the interior of each pressure chamber, and a nozzle for ejecting the liquid in each pressure chamber therefrom in the form of droplets. A recovery controller brings the pressure generating element corresponding to the communication port included in a partial region of the liquid filling chamber into operation to cause the corresponding nozzle to eject the droplets. This produces a flow of the liquid directed toward the partial region in the liquid filling chamber to efficiently diffuse precipitable ingredients accumulating in the liquid filling chamber, thereby efficiently eliminating the accumulation of the precipitable ingredients in the liquid filling chamber in communication with the pressure chambers.

22 Claims, 12 Drawing Sheets

APPARATUS FOR AND METHOD OF EJECTING DROPLETS

BACKGROUND OF THE INVENTION

Field of the Invention

The present invention relates to a droplet ejecting apparatus and a droplet ejecting method which use pressure generating elements to eject droplets.

Description of the Background Art

A droplet ejecting apparatus which varies the pressure in a plurality of pressure chambers filled with a liquid by means of pressure generating elements to thereby eject the liquid filling the pressure chambers from nozzles in the form of droplets has been hitherto employed (as disclosed in Japanese Patent Application Laid-Open No. 2012-161917, for example).

In the droplet ejecting apparatus (droplet jetting apparatus) disclosed in Japanese Patent Application Laid-Open No. 2012-161917, an ejecting head (recording head) includes the plurality of pressure chambers and the plurality of nozzles provided in the respective pressure chambers. Ink in the pressure chambers is jetted out of the nozzles by the deformation of piezoelectric elements provided in the respective pressure chambers. The ejecting head further includes a liquid filling chamber (reservoir) in communication with the pressure chambers and serving as a supply path for supplying the ink from an ink supply source to the respective pressure chambers (paragraph 0025 and FIG. 3).

When such an ejecting head ejects a liquid containing precipitable ingredients after a prolonged pause, the precipitable ingredients are prone to precipitate in the liquid filling chamber and in the pressure chambers. The precipitation of the precipitable ingredients in the liquid filling chamber might give rise to a problem such that liquid flow passages near communication ports which provide communication between the liquid filling chamber and the pressure chambers are narrowed down by the precipitable ingredients.

To solve the problem of the precipitation in the pressure chambers, what is called spitting and flushing have been hitherto performed. In the spitting and flushing, ink is in general ejected from all of the nozzles in unison by the same ejection method as a normal ejecting operation. This causes the ejection of precipitated parts in the pressure chambers from the nozzles to eliminate the accumulation of the precipitable ingredients in the pressure chambers.

In the conventional spitting and flushing, liquid flows directed from the liquid filling chamber toward the pressure chambers are produced in the liquid filling chamber, but are not sufficient to eliminate the precipitation in the liquid filling chamber. To solve the problem of the precipitation in the liquid filling chamber, what is called a purge has been performed which causes a large amount of ink to be ejected by the application of an external force to the ejecting head.

Unfortunately, the purge consumes a greater amount of ink than the spitting and flushing. Also, the purge requires a greater number of steps than the spitting and flushing because the cleaning of the ejecting head is necessary after the purge. It is hence desirable that the precipitation in the liquid filling chamber is eliminated by what is called the spitting and flushing without the use of the purge.

SUMMARY OF THE INVENTION

In view of the foregoing, it is an object of the present invention to provide a technique capable of efficiently eliminating the accumulation of precipitable ingredients in a liquid filling chamber in communication with pressure chambers.

To solve the aforementioned problems, a first aspect of the present invention is intended for a droplet ejecting apparatus comprising: a liquid filling chamber filled with a liquid; a plurality of pressure chambers in communication with the liquid filling chamber and filled with the liquid; and a recovery controller for controlling the ejection of the liquid from the pressure chambers, each of the pressure chambers including a communication port in communication with the liquid filling chamber, a pressure generating element for exerting pressure on the liquid which fills the interior of each of the pressure chambers, and a nozzle for ejecting the liquid in each of the pressure chambers therefrom in the form of droplets, the recovery controller bringing the pressure generating element corresponding to the communication port included in a first partial region of the liquid filling chamber into operation to cause the nozzle corresponding to the first partial region to eject the droplets.

A second aspect of the present invention is intended for a method of ejecting droplets in a droplet ejecting apparatus including a liquid filling chamber filled with a liquid and a plurality of pressure chambers each having a communication port in communication with the liquid filling chamber, the method ejecting the liquid in the form of droplets from a nozzle provided in each of the pressure chambers. The method comprises the step of a) performing a recovery operation of ejecting the droplets from the nozzle corresponding to the communication port included in a first partial region of the liquid filling chamber.

According to the first and second aspects of the present invention, a flow of the liquid directed toward the first partial region is produced in the liquid filling chamber. This efficiently diffuses precipitable ingredients accumulating in the liquid filling chamber.

These and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment according to the present invention will now be described with reference to the drawings. A direction in which printing paper 9 is transported is referred to hereinafter as a "transport direction".

1. Configuration of Recording Apparatus

Figure 1:
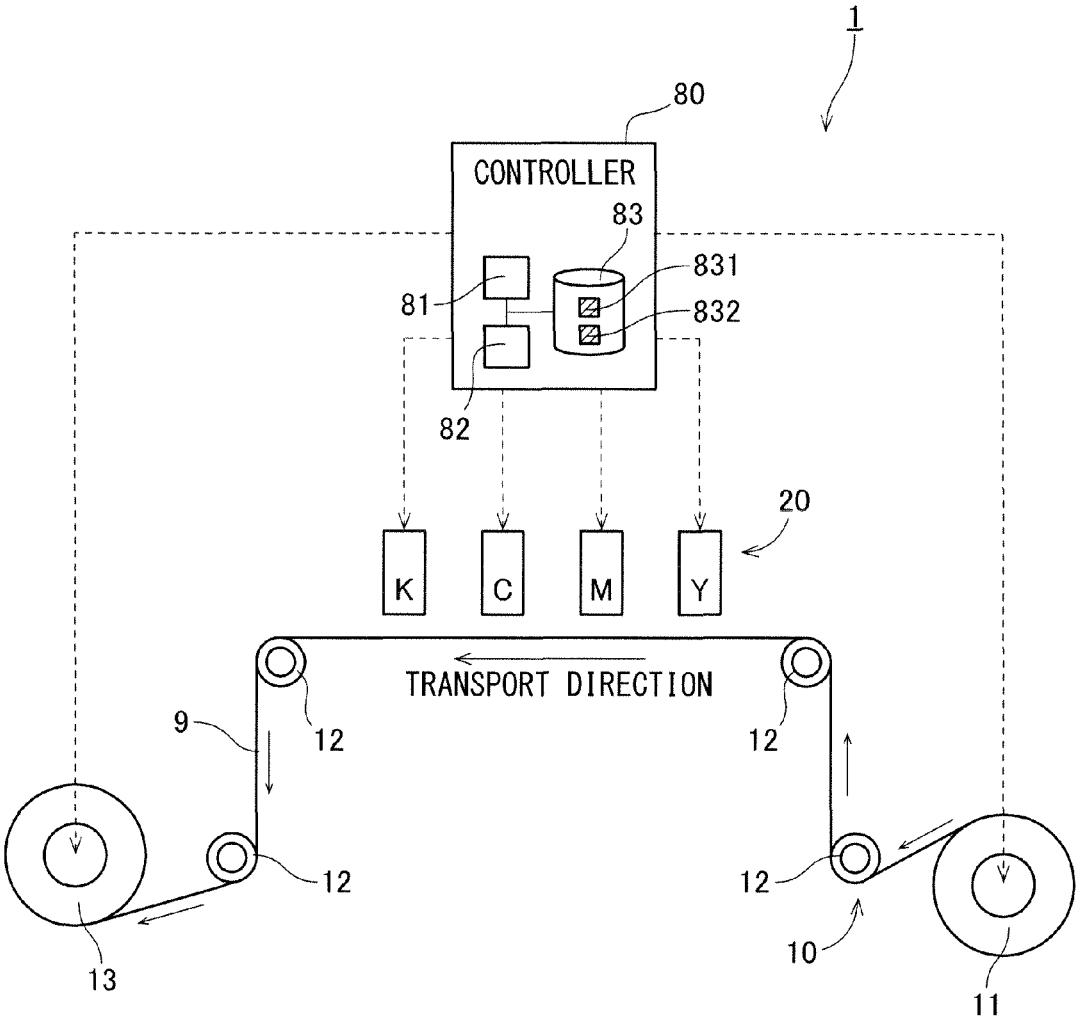
FIG. 1 is a view conceptually showing the configuration of a recording apparatus according to one preferred embodiment of the present invention.
Figure 2:
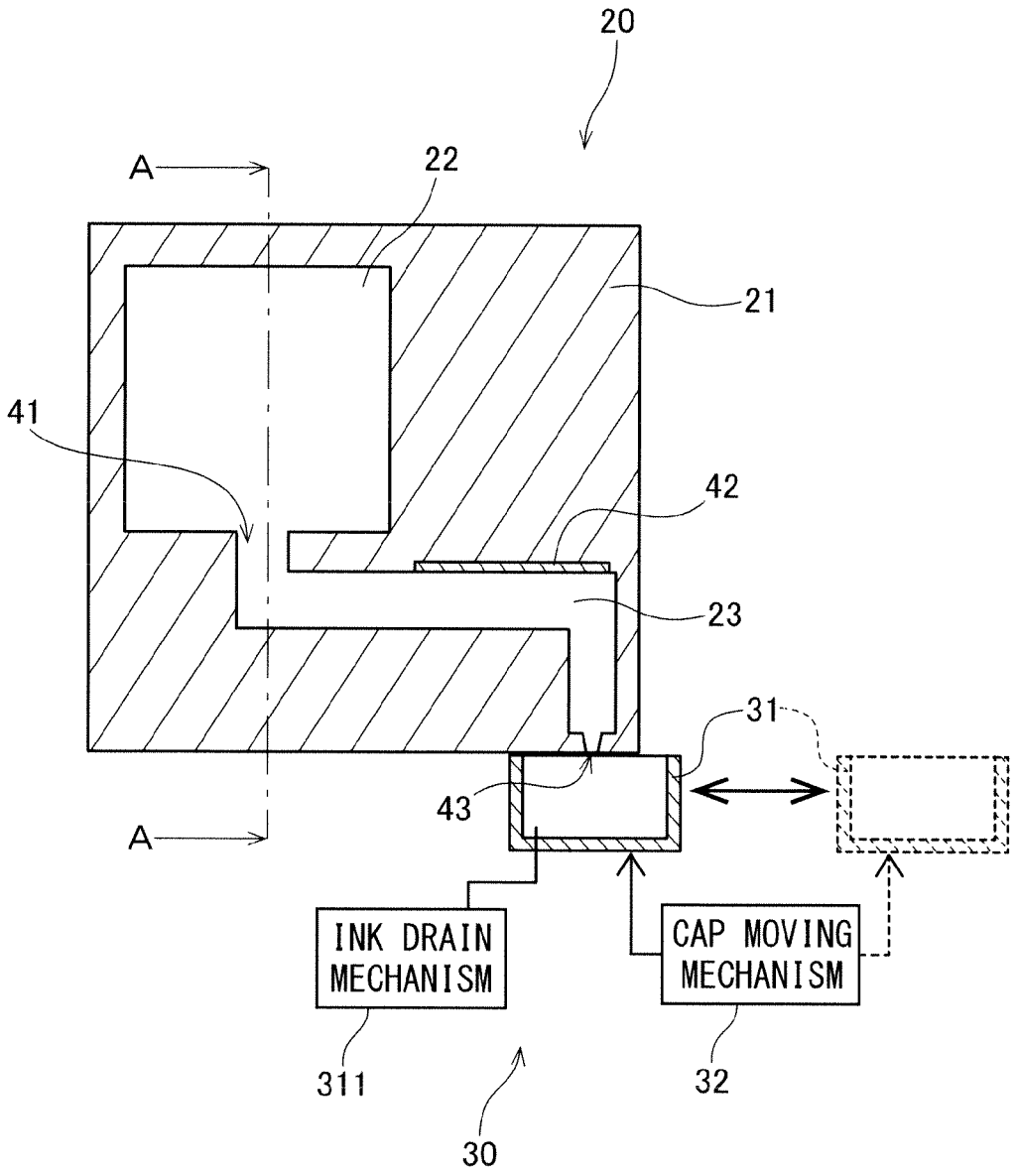
FIG. 2 is a vertical sectional view of a recording head according to the preferred embodiment.
Figure 3:
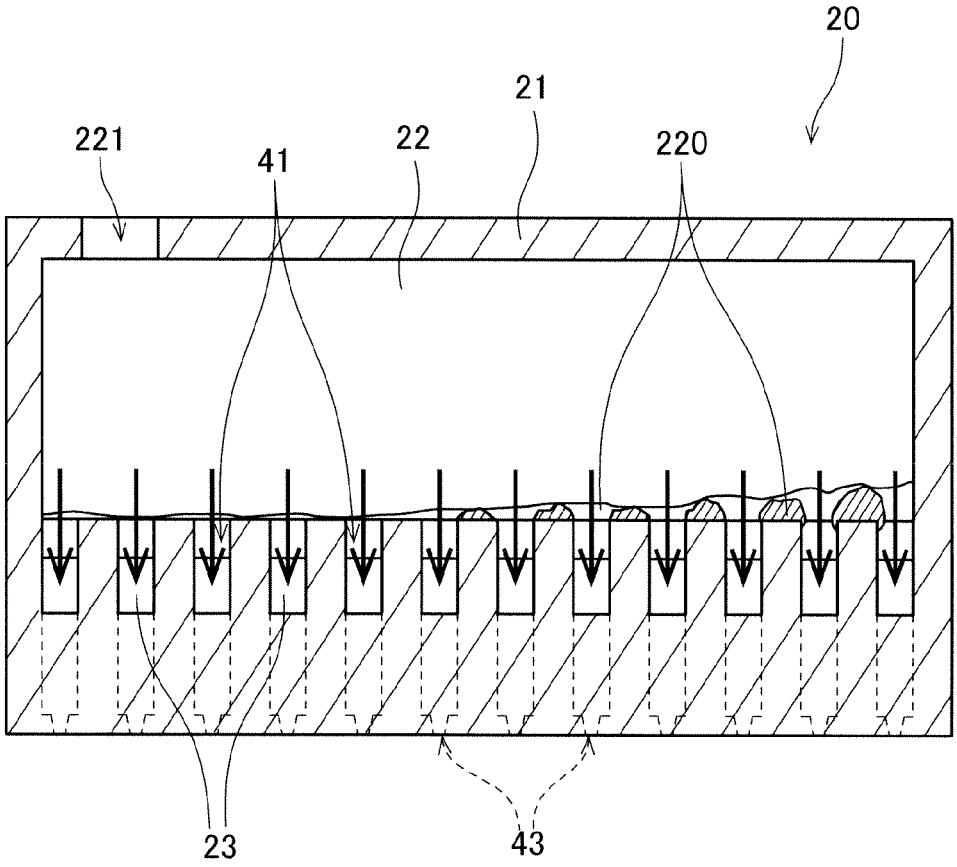
FIG. 3 is a sectional view of the recording head taken along the line A-A of FIG. 2 according to the preferred embodiment.
Figure 4:
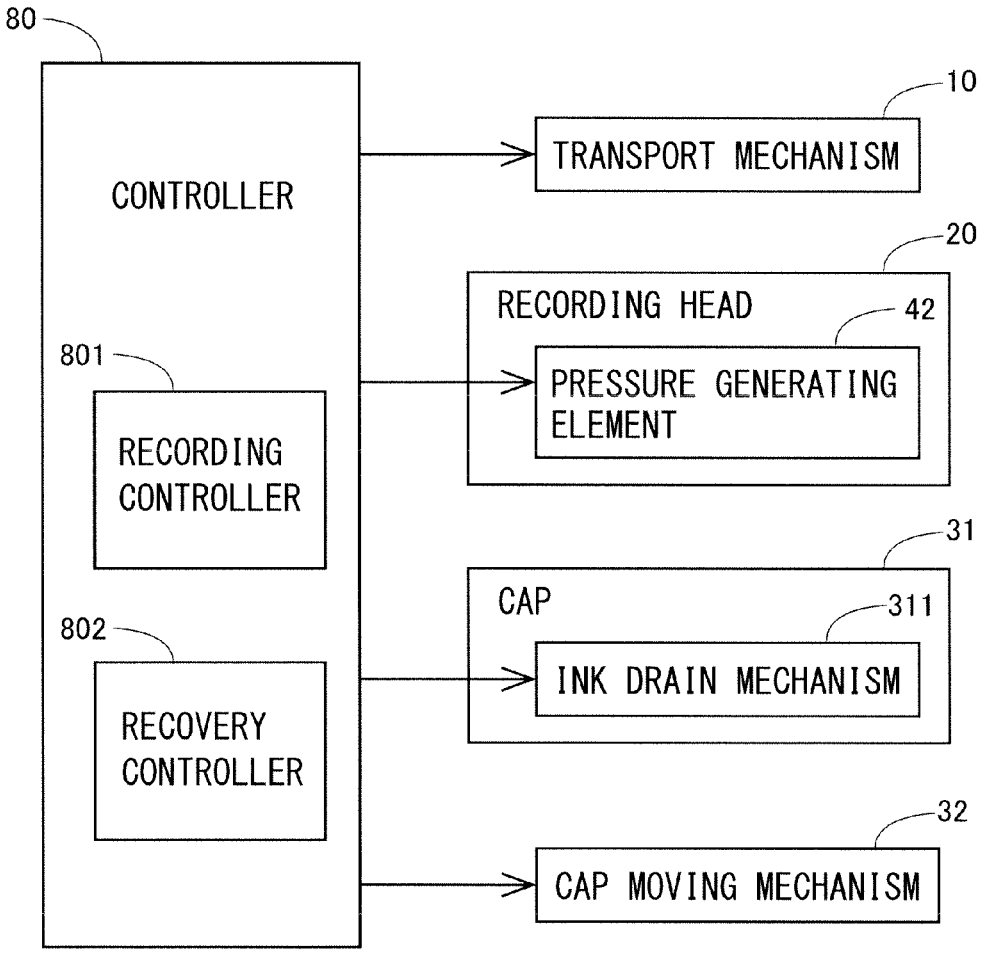
FIG. 4 is a block diagram showing a control system for the recording apparatus according to the preferred embodiment.

FIG. 1 is a view conceptually showing the configuration of a recording apparatus 1 which is one preferred embodiment of a droplet ejecting apparatus according to the present invention. FIG. 2 is a vertical sectional view of a recording head 20 in the recording apparatus 1. FIG. 3 is a sectional view of the recording head 20 taken along the line A-A of FIG. 2. FIG. 4 is a block diagram showing a control system for the recording apparatus 1.

The recording apparatus 1 is an inkjet printing apparatus which records a color image on the printing paper 9 that is an elongated strip-shaped recording medium by ejecting ink droplets from a plurality of recording heads 20 onto the printing paper 9 while transporting the printing paper 9. As shown in FIGS. 1 and 2, the recording apparatus 1 includes a transport mechanism 10, the four recording heads 20, a cap mechanism 30, and a controller 80.

The transport mechanism 10 is a mechanism for transporting the printing paper 9 in the transport direction that is the longitudinal direction of the printing paper 9. The transport mechanism 10 according to the present preferred embodiment includes an unwinder 11, a plurality of rollers 12 and a winder 13.

A motor (not shown) serving as a power source is coupled to the unwinder 11, the plurality of rollers 12 and the winder 13. Thus, the unwinder 11, the plurality of rollers 12 and the winder 13 rotate when the controller 80 drives the motor. The printing paper 9 is accordingly unwound from the unwinder 11, and is transported along a transport path formed by the rollers 12 to the winder 13.

Each of the rollers 12 rotates about a horizontal axis to guide the printing paper 9 downstream in the transport direction. The printing paper 9 comes in contact with the rollers 12, so that tension is applied to the printing paper 9. After being transported, the printing paper 9 is wound and collected on the winder 13. In this manner, the transport mechanism 10 in the present preferred embodiment constitutes a "second moving mechanism" which moves the printing paper 9 and the recording head 20 relative to each other.

The four recording heads 20 are arranged in spaced apart relation in the transport direction over the transport path of the printing paper 9. The four recording heads 20 are ejecting heads for ejecting ink droplets of yellow (Y), magenta (M), cyan (C) and black (K) onto the upper surface of the printing paper 9. The recording apparatus 1 according to the present preferred embodiment is what is called a one-pass type recording apparatus which records a desired image pattern on the printing paper 9 by ejecting ink droplets from the recording heads 20 while the printing paper 9 passes under the recording heads 20 only once. Only the structure of one of the recording heads 20 will be described below because the four recording heads 20 are substantially similar in structure to each other.

As shown in FIGS. 2 and 3, one recording head 20 includes a housing 21, an ink chamber 22 provided in the housing 21, and a plurality of pressure chambers 23 provided in the housing 21.

The ink chamber 22 is a liquid filling chamber which is primarily filled with ink. As shown in FIG. 3, an upper portion of the ink chamber 22 is provided with an ink supply port 221 for supplying ink therethrough from an ink tank (not shown) for storing ink therein into the ink chamber 22.

Pressure in the ink chamber 22 is adjusted so that menisci are formed in nozzles 43 to be described later which are provided in the pressure chambers 23 in communication with the ink chamber 22. Thus, the pressure in the ink chamber 22 is set in consideration for a positional relationship between the ink chamber 22 and the pressure chambers 23 relative to each other. In the present preferred embodiment, the pressure in the ink chamber 22 is set to a negative pressure because the pressure chambers 23 are disposed under the ink chamber 22.

As shown in FIG. 2, each of the pressure chambers 23 includes a communication port 41, a pressure generating element 42 and a nozzle 43. Although the pressure chambers 23 in the present preferred embodiment are disposed under the ink chamber 22, the pressure chambers 23 may be disposed on the same level as or over the ink chamber 22.

The communication port 41 provides communication between the interior of each of the pressure chambers 23 and the ink chamber 22. Thus, when the pressure in one of the pressure chambers 23 is decreased, ink is supplied from the ink chamber 22 through the communication port 41 into the pressure chamber 23.

The pressure generating element 42 is disposed at the upper wall surface of each of the pressure chambers 23. The nozzle 43 is disposed at the lower surface of each of the pressure chambers 23 to provide communication between each pressure chamber 23 and exterior space. When no ink is ejected, a liquid surface of ink forms a meniscus inside the nozzle 43. The nozzle 43 has a lower end portion which is exposed at the lower surface of the housing 21.

The individual nozzles 43 of the recording head 20 are arranged two-dimensionally at the lower surface of the housing 21. In the recording head 20 shown in FIGS. 2 and 3, the nozzles 43 are shown as arranged one-dimensionally at the lower surface of the housing 21 for the purpose of facilitating the illustration. The individual nozzles 43 are staggered or offset in a direction orthogonal to the transport direction, so that each of the nozzles 43 is assigned to a region having a width of one pixel on the printing paper 9.

The recording head 20 according to the present preferred embodiment is an ejecting head of what is called a piezoelectric type. Thus, the pressure generating element 42 according to the present preferred embodiment is a piezoelectric element. When an ejection signal that is an electric signal is sent from the controller 80 to one of the pressure generating element 42, the pressure generating element 42 is deformed to exert pressure on the ink which fills the pressure chamber 23. When the pressure in the pressure chamber 23 is increased, the ink in the pressure chamber 23 is ejected in the form of droplets from the nozzle 43.

The recording heads according to the present invention are not limited to those of a piezoelectric type. For example, the recording heads according to the present invention may be what is called thermal recording heads in which a heater used as a pressure generating element heats the liquid in the pressure chambers to generate bubbles, thereby increasing the pressure in the pressure chambers.

As shown in FIG. 2, the cap mechanism 30 includes a cap 31 and a cap moving mechanism 32. The cap 31 covers a surface of the recording head 20 which has the nozzles 43 for a time period during which the recording head 20 performs no recording on the printing paper 9. This suppresses the evaporation of a solvent of the ink from the meniscus surfaces of the ink formed in the nozzles 43 for the time period during which no recording is performed on the printing paper 9 which in turn results in the solidification or agglomeration of the ink near the nozzles 43.

The cap 31 includes an ink drain mechanism 311. This allows spitting, flushing or a purge to be performed while the cap 31 covers the nozzles 43. After being ejected from the recording head 20 toward the cap 31, the ink is drained through the ink drain mechanism 311 from the interior of the cap 31.

As mentioned above, the cap moving mechanism 32 places the cap 31 at a nozzle-facing position (i.e., which is opposed to the nozzles) under the recording head 20 for the time period during which the recording head 20 performs no recording on the printing paper 9. When the recording head 20 performs the recording on the printing paper 9, on the other hand, the cap moving mechanism 32 moves the cap 31 to a standby position (indicated by broken lines in FIG. 2) which does not vertically overlap the recording head 20 before the start of an image recording step. After the completion of the image recording step, the cap moving mechanism 32 moves the cap 31 to the nozzle-facing position under the recording head 20 to cover the nozzles 43 with the cap 31. In this manner, the cap moving mechanism 32 constitutes a "first moving mechanism" which moves the cap 31 and the recording head 20 relative to each other.

Although the cap 31 placed at the nozzle-facing position covers the nozzles 43 in the present preferred embodiment, the present invention is not limited to this. When ink which is less prone to cause the problem of the evaporation from the meniscus surfaces is used, the cap 31 need not fully cover the nozzles 43. Although the cap 31 shown in FIG. 2 does not cover the entire lower surface of the recording head 20, the cap 31 may cover the entire lower surface of the recording head 20.

When the recording apparatus 1 executes the image recording step, ink droplets are ejected from the nozzles 43 onto the upper surface of the printing paper 9 while the transport mechanism 10 transports the printing paper 9. In FIGS. 2 and 3, only the one ink chamber 22 and the twelve pressure chambers 23 are shown as provided in the housing 21 of the recording head 20 for the purpose of facilitating the illustration. In actuality, the recording head 20, however, has a plurality of ink chambers 22 and a large number of pressure chambers 23. In each actual recording head 20, the nozzles 43 are positioned in opposed relation to the substantially full width of the upper surface of the printing paper 9. This allows each actual recording head 20 to eject ink droplets across the substantially full width of the upper surface of the printing paper 9.

For the recording on the printing paper 9, the plurality of recording heads 20 may be used to eject ink droplets of the same color onto the printing paper 9. For example, two or more recording heads 20 which eject ink droplets of the same color may be disposed in combination along the width of the printing paper 9 to thereby eject ink droplets of that color across the substantially full width of the upper surface of the printing paper 9.

The four recording heads 20 corresponding to the respective colors sequentially perform such a process of ejecting ink droplets to thereby form a color pattern on the upper surface of the printing paper 9.

The controller 80 is a section for controlling the operations of the parts in the recording apparatus 1. As schematically shown in FIG. 1, the controller 80 according to the present preferred embodiment includes a computer having an arithmetic processor 81 such as a CPU, a memory 82 such as a RAM, and a storage part 83 such as a hard disk drive. As shown in FIG. 4, the controller 80 is electrically connected to the transport mechanism 10, the four recording heads 20, the ink drain mechanism 311 and the cap moving mechanism 32.

The controller 80 temporarily reads a computer program 831 and data 832 which are stored in the storage part 83 onto the memory 82. The arithmetic processor 81 performs arithmetic processing based on the computer program 831 and the data 832, so that the controller 80 controls the operations of the parts in the recording apparatus 1. Thus, a printing process and a recovery operation to be described later in the recording apparatus 1 proceed. It should be noted that the controller 80 may be formed by electronic circuitry.

As shown in FIG. 4, the controller 80 according to the present preferred embodiment includes a recording controller 801 and a recovery controller 802 which are processing parts implemented in the form of software. The functions of the recording controller 801 and the recovery controller 802 are implemented by the arithmetic processor 81, the memory 82 and the storage part 83 described above.

For the recording of an image pattern on the upper surface of the printing paper 9, the recording controller 801 controls the ejection of ink droplets from the nozzles 43. Thus, the recording controller 801 controls the ejection position and ejection rate of ink droplets from the nozzles 43 during the recording of the image pattern.

In the present preferred embodiment, the control of the ejection position of ink droplets is exercised by controlling the ejection timing of the ink droplets from the nozzles 43. In the present preferred embodiment, ink droplets are ejected from the nozzles 43 while the printing paper 9 is transported at a constant speed. While passing under the recording heads 20, the printing paper 9 receives ink droplets ejected from predetermined ones of the nozzles 43. Thus, the impact positions of ink droplets on the printing paper 9 in the transport direction are determined by the ejection timing of the ink droplets from the nozzles 43.

In the present preferred embodiment, the ejection rate and ejection timing of ink droplets are controlled by an ejection signal sent from the controller 80 to the pressure generating elements 42. The recording controller 801 generates the ejection signal to be outputted to the pressure generating elements 42, based on an inputted image pattern and positional information about the printing paper 9.

The recovery controller 802 controls the ejection of ink droplets from the nozzles 43 during the recovery operation of ejecting ink droplets toward the cap 31 placed at the positions opposed to the nozzles 43. Thus, the recovery controller 802 controls the ejection rate and ejection timing of ink droplets from the nozzles 43 during the non-recording of an image pattern. Specifically, the recovery controller 802 generates the ejection signal to be outputted to the pressure generating elements 42, based on a predetermined recovery operation pattern.

The recording controller 801 and the recovery controller 802 according to the present preferred embodiment may select the ink droplets for ejection from the nozzles 43 from among ink droplets of three types of liquid volumes: large, medium and small sizes. Specifically, the recording controller 801 and the recovery controller 802 determine the ejection timing, and select the liquid volume size to determine the ejection rate, thereby generating the ejection signal to be outputted to the pressure generating elements 42.

2. Recovery Operation

Figure 5:
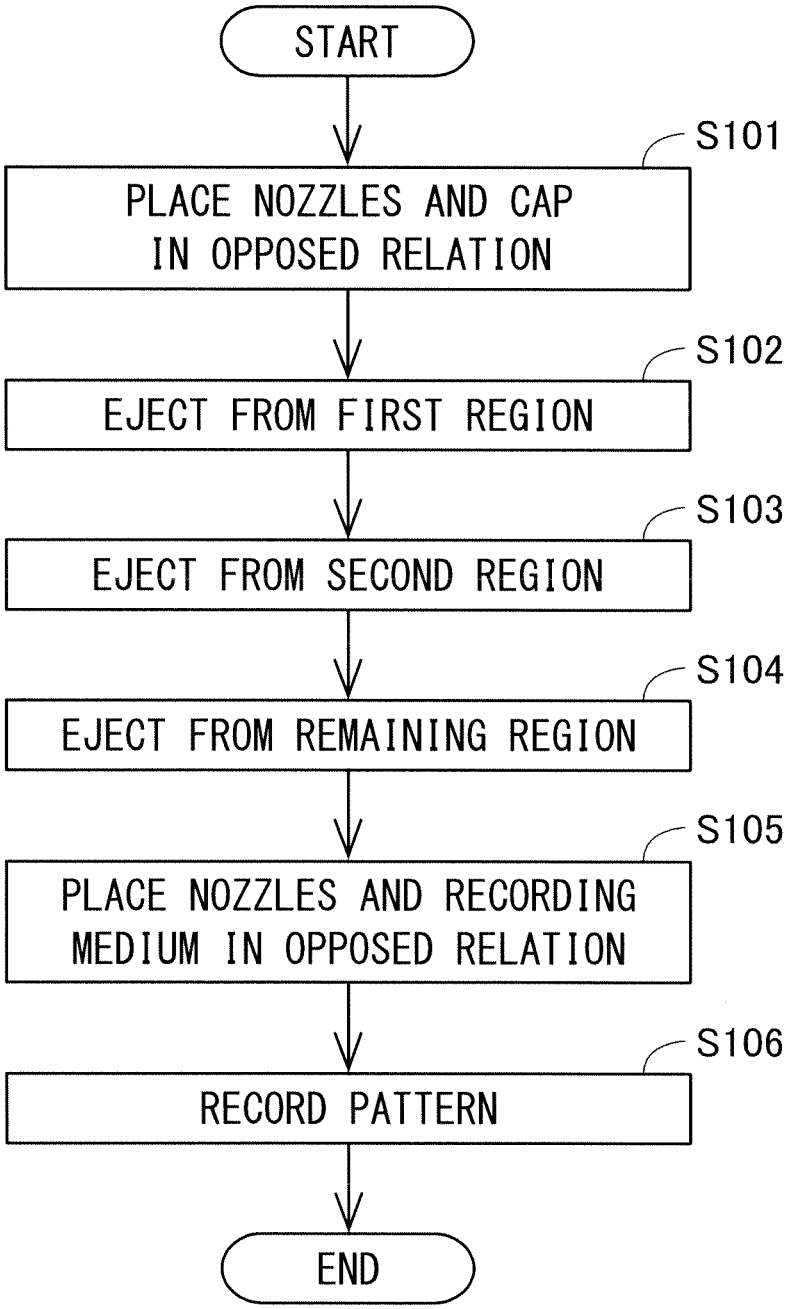
FIG. 5 is a flow diagram showing a procedure for a recovery operation in the recording apparatus according to the preferred embodiment.
Figure 6:
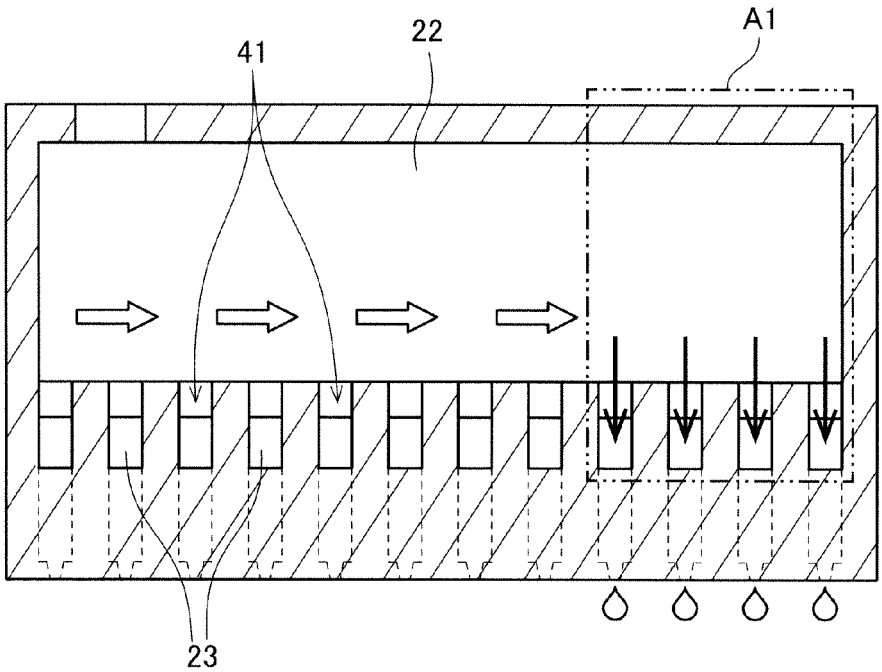
FIG. 6 is a view showing a first recovery step according to the preferred embodiment.
Figure 7:
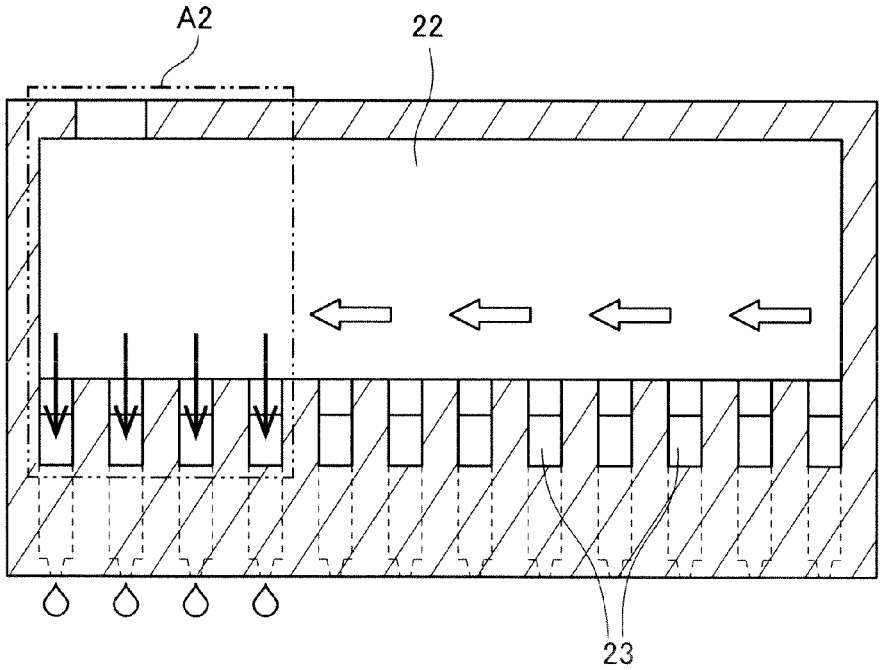
FIG. 7 is a view showing a second recovery step according to the preferred embodiment.

Next, the recovery operation of each recording head 20 in the recording apparatus 1 will be described with reference to FIG. 3 and FIGS. 5 to 7. FIG. 5 is a flow diagram showing a procedure for the recovery operation according to the present preferred embodiment. FIG. 6 is a view showing one recording head 20 in a first recovery step. FIG. 7 is a view showing the recording head 20 in a second recovery step.

In the recording apparatus 1 according to the present preferred embodiment, the ink ejected from the recording head 20 contains precipitable ingredients. For this reason, precipitable ingredients 220 precipitate downwardly and accumulate in the ink chamber 22 of the recording head 20, as shown in FIG. 3, if ink is not ejected for a long period of time. There are cases in which the precipitable ingredients 220 accumulate unevenly in the ink chamber 22. There are regions in which the accumulation of the precipitable ingredients 220 is particularly prone to occur, depending on the shape of the ink chamber 22, the position of the ink supply port 221 in the ink chamber 22, and the positions of the communication ports 41 in the ink chamber 22.

In the conventional spitting and flushing, the controller 80 sends the ejection signal to the pressure generating elements 42 of all of the pressure chambers 23 of the recording head 20, so that ink droplets are ejected in unison from all of the nozzles 43. This produces flows of ink from the interior of the ink chamber 22 through the communication ports 41 into the pressure chambers 23, as indicated by solid arrows in FIG. 3. In this case, the precipitable ingredients 220 accumulating near the communication ports 41 are removed to some extent, but it is difficult to eliminate the accumulation of the precipitable ingredients 220 between adjacent ones of the communication ports 41. To solve such a problem, the recovery operation to be described below is performed in the present invention. The recovery operation according to the present preferred embodiment is a kind of spitting which is performed on the cap 31 before the recording on the printing paper 9.

With reference to FIG. 5, an instruction signal for the recording of an image pattern on the printing paper 9 is initially inputted from the outside to the controller 80. In response to the instruction signal, the recovery controller 802 of the controller 80 causes the cap moving mechanism 32 to move the cap 31 to a position opposed to the nozzles 43 of the recording head 20 and covering the surface of the recording head 20 which has the nozzles 43 (Step S101). When the cap 31 is already placed at that position, the controller 80 does not cause the cap 31 to move.

Next, as shown in FIG. 6, the first recovery step is performed in which the recovery controller 802 brings the pressure generating elements 42 corresponding to the communication ports 41 included in a first region A1 which is a partial region of the ink chamber 22 into operation to cause the nozzles 43 corresponding to the first region A1 to eject ink droplets simultaneously a plurality of times (Step S102). In the present preferred embodiment, ink droplets are ejected a plurality of times from the nozzles 43 corresponding to the first region A1, with the cap 31 placed at the position opposed to the surface of the recording head 20 which has the nozzles 43. The first region A1 is the outermost region on a first side of a plurality of regions obtained by dividing the ink chamber 22 in the longitudinal direction.

Ejecting ink droplets from the nozzles 43 corresponding to the first region A1 a plurality of times in this manner produces a horizontal flow of ink directed from a second side opposite the first side toward the first side in the ink chamber 22, as indicated by hollow arrows in FIG. 6. That is, the flow of ink thus produced is different in direction from the flows of ink produced by the conventional spitting as indicated by the solid arrows in FIG. 3. Thus, the precipitable ingredients 220 accumulated in a lower part of the ink chamber 22 are dispersed by the horizontal flow of ink. At the same time, the accumulation of the precipitable ingredients 220 is also eliminated in the pressure chambers 23 in which the ejection is performed.

Subsequently, as shown in FIG. 7, the second recovery step is performed in which the recovery controller 802 brings the pressure generating elements 42 corresponding to the communication ports 41 included in a second region A2 which is another partial region in the ink chamber 22 into operation to cause the nozzles 43 corresponding to the second region A2 to eject ink droplets simultaneously a plurality of times (Step S103). In Step S103, ink droplets are ejected simultaneously a plurality of times from the nozzles 43 corresponding to the second region A2, with the cap 31 placed at the position opposed to the surface of the recording head 20 which has the nozzles 43, as in Step S102. The second region A2 is the outermost region on the second side of the plurality of regions obtained by dividing the ink chamber 22 in the longitudinal direction.

This produces a horizontal flow of ink opposite in direction from that produced in Step S102, i.e. from the first side toward the second side, in the ink chamber 22, as indicated by hollow arrows in FIG. 7. Thus, a force opposite in direction from that produced in Step S102 is applied to the precipitable ingredients 220 still accumulating in the ink chamber 22. The precipitable ingredients 220 accumulated in the lower part of the ink chamber 22 are hence further dispersed. At the same time, the accumulation of the precipitable ingredients 220 is also eliminated in the pressure chambers 23 in which the ejection is performed.

The liquid volume size of the ink droplets ejected from the nozzles 43 is the large size in Step S102 which is the first recovery step and in Step S103 which is the second recovery step. Ejection of ink of as high a liquid volume as possible at a time allows the horizontal flow to be produced in the ink chamber 22 in a short time.

In the present preferred embodiment, the first region A1 and the second region A2 are set at positions which do not overlap each other. This produces the horizontal flow of ink in Step S103 in the first region A1 in which the horizontal flow of ink is less prone to be produced in Step S102. This efficiently disperses the precipitable ingredients 220 in the ink chamber 22.

The number of times of ejection in Step S102 and Step S103 is appropriately set to the number of times that the horizontal flow of ink is produced in consideration for the type of ink to be used, the liquid volume size of ink droplets, the shape of the ink chamber 22, the arrangement of the communication ports 41 in the ink chamber 22, and the like. Although all of the nozzles 43 corresponding to the regions A1 and A2 eject ink droplets simultaneously a plurality of times in Steps S102 and S103, the present invention is not limited to this. It is only necessary that the plurality of nozzles 43 corresponding to each of the regions A1 and A2 eject ink droplets within a certain period of time. For example, the nozzles 43 of adjacent ones of the pressure chambers 23 may eject ink droplets at slightly different times to prevent electrical influence (what is called crosstalk) in adjacent ones of the pressure chambers 23.

Thereafter, a third recovery step is performed in which the recovery controller 802 causes the nozzles 43 of the pressure chambers 23 corresponding to the communication ports 41 included in the remaining region different than the first and second regions A1 and A2 in the ink chamber 22 to eject ink droplets a plurality of times (Step S104). This eliminates the accumulation of the precipitable ingredients 220 in these pressure chambers 23. It should be noted that Step S104 is intended to eliminate the accumulation of the precipitable ingredients 220 in these pressure chambers 23. Thus, it is not necessary to produce a flow of ink in the ink chamber 22 in Step S104. For this reason, the number of times of ejection in Step S104 may be smaller than that in Steps S102 and S103.

In the present preferred embodiment, ink is ejected from the nozzles 43 toward the cap 31 in Step S102 which is the first recovery step, Step S103 which is the second recovery step and Step S104 which is the third recovery step. In Steps S102 to S104, the recovery controller 802 brings the ink drain mechanism 311 provided in the cap 31 into operation. Thus, ink ejected to the cap 31 is collected, and is carried to a waste line or a recycle line.

After the completion of the first to third recovery steps in Steps S102 to S104, the procedure proceeds to the image recording step. First, the recording controller 801 of the controller 80 brings the cap moving mechanism 32 into operation to move the cap 31 to the standby position. Next, the recording controller 801 brings the transport mechanism 10 into operation to place the printing paper 9 at a predetermined position. This places a recording region of the printing paper 9 for the recording of an image pattern thereon and a surface of the most upstream recording head 20 which has the nozzles 43 at mutually opposed positions (Step S105).

While the transport mechanism 10 transports the printing paper 9, the recording controller 801 causes the nozzles 43 of the recording heads 20 to eject ink droplets onto the recording region of the printing paper 9 in accordance with the image pattern to be recorded. Thus, the image pattern is recorded on the recording region of the printing paper 9 (Step S106).

In the present preferred embodiment, the recovery steps in Steps S102 to S104 are performed before the image recording step in Step S106. Eliminating the accumulation of the precipitable ingredients 220 in the ink chamber 22 before the image recording step in this manner efficiently suppresses the occurrence of color irregularities of ink and ejection failures of ink in the image recording step.

3. Modifications

While the one preferred embodiment according to the present invention has been described hereinabove, the present invention is not limited to the aforementioned preferred embodiment.

3-1. Variations of Ejection Region in Recovery Operation

In the recovery steps of the aforementioned preferred embodiment, the recovery operation is performed in which ink droplets are ejected from the nozzles 43 corresponding to the first region A1 which is the outermost region on the first side of the plurality of regions obtained by dividing the ink chamber 22 in the longitudinal direction, the second region A2 which is the outermost region on the second side, and the remaining region in the order named. However, a variety of variations of the setting of the regions for the recovery operation and the order of the regions for the recovery operation may be contemplated in consideration for the type of ink to be used, the shape of the ink chamber 22, and the like. Examples of the variations of the recovery operation will be presented below.

<3-1-1. First Variation>

FIGS. 8 to 11 are views showing first to fourth recovery steps of the recovery operation according to a first variation. As shown in FIGS. 8 to 11, a first region B1, a second region B2, a third region B3 and a fourth region B4 are regions arranged from the first side toward the second side in the longitudinal direction of the ink chamber 22. Two of the first to fourth regions B1 to B4 which are adjacent to each other in the longitudinal direction of the ink chamber 22 have an overlap. In this manner, the plurality of ejection regions may have an overlap.

Figure 8:
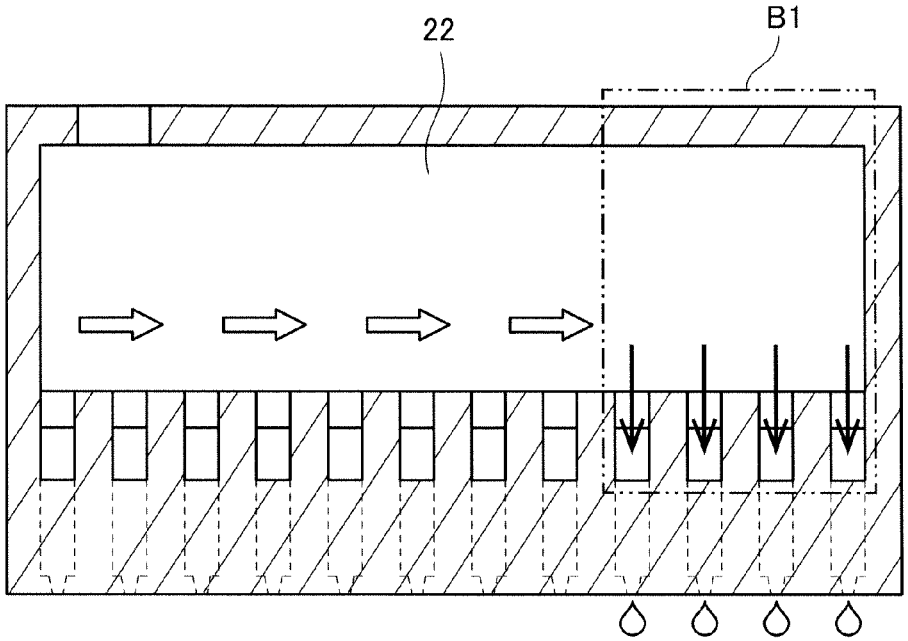
FIGS. 8, 9, 10 and 11 are first, second, third and fourth recovery steps, respectively, according to another preferred embodiment of the present invention.

In the recovery operation, the first recovery step is initially performed in which ink droplets are ejected from the nozzles 43 corresponding to the first region B1. This produces a horizontal flow of ink directed from the second side toward the first side in the ink chamber 22, as shown in FIG. 8.

Figure 9:
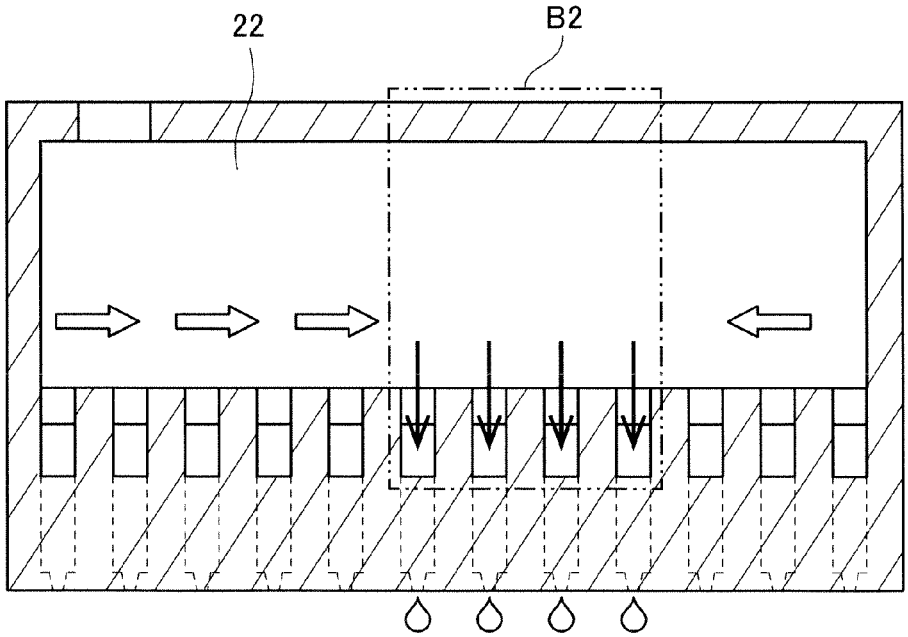

Next, the second recovery step is performed in which ink droplets are ejected from the nozzles 43 corresponding to the second region B2. This produces a horizontal flow of ink directed from the first side toward the second side in a region of the ink chamber 22 which is closer to the first side with respect to the second region B2, as shown in FIG. 9. Also, a horizontal flow of ink directed from the second side toward the first side is produced in a region the ink chamber 22 which is closer to the second side with respect to the second region B2, following the first recovery step.

Figure 10:
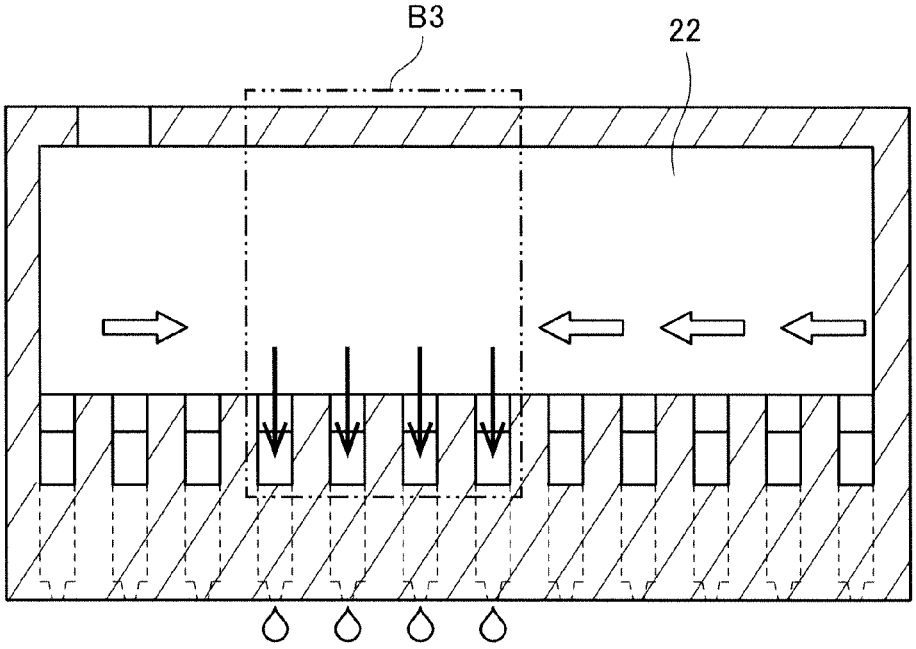

Subsequently, the third recovery step is performed in which ink droplets are ejected from the nozzles 43 corresponding to the third region B3. This produces a horizontal flow of ink directed from the first side toward the second side in a region of the ink chamber 22 which is closer to the first side with respect to the third region B3, following the second recovery step, as shown in FIG. 10. Also, a horizontal flow of ink directed from the second side toward the first side is produced in a region of the ink chamber 22 which is closer to the second side with respect to the third region B3, following the first and second recovery steps.

Figure 11:
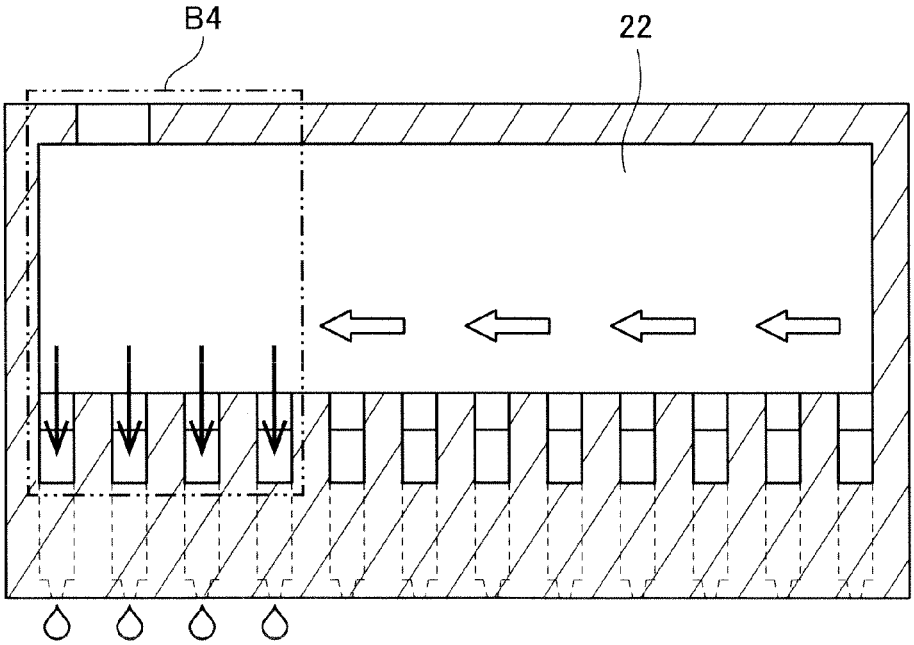

Finally, the fourth recovery step is performed in which ink droplets are ejected from the nozzles 43 corresponding to the fourth region B4. This produces a horizontal flow of ink directed from the first side toward the second side in the ink chamber 22, as shown in FIG. 11.

In this manner, the region corresponding to the nozzles 43 which eject ink droplets is moved step by step from the first side toward the second side in the ink chamber 22, so that the direction of the flow of ink in the ink chamber 22 is smoothly changed. The ejection of ink droplets from the nozzles 43 corresponding to the entire region in the ink chamber 22 eliminates the accumulation of the precipitable ingredients 220 in all of the pressure chambers 23 in communication with the ink chamber 22.

<3-1-2. Second Variation>

FIGS. 12 to 15 are views showing first to fourth recovery steps of the recovery operation according to a second variation. As shown in FIGS. 12 to 15, a first region C1, a second region C2, a third region C3 and a fourth region C4 are four regions obtained by dividing the ink chamber 22 in the longitudinal direction thereof, and are arranged from the first side toward the second side in the order named. In the second variation, two of the first to fourth regions C1 to C4 which are adjacent to each other in the longitudinal direction of the ink chamber 22 do not have any overlap, but may have an overlap.

Figure 12:
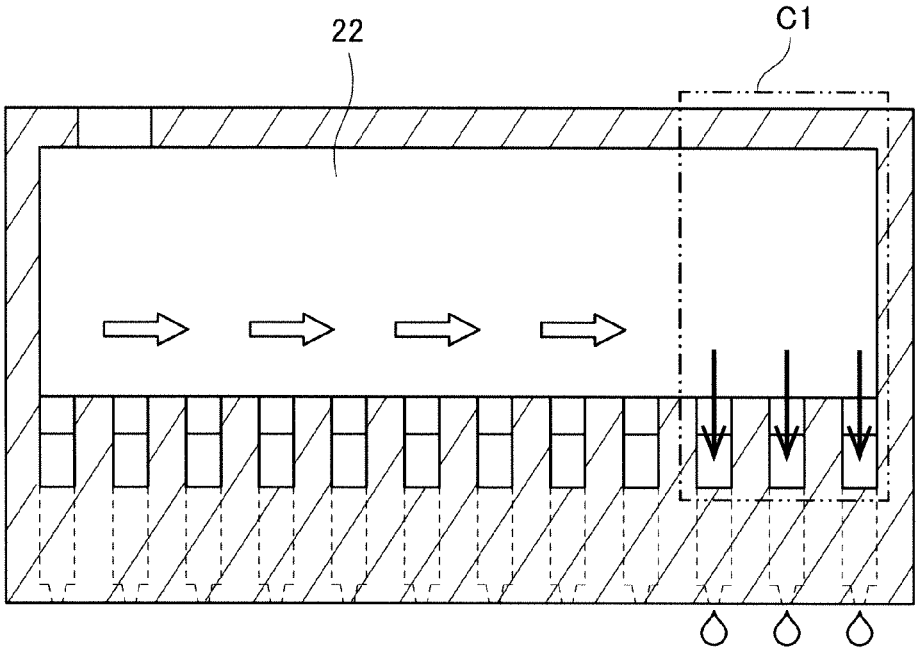
FIGS. 12, 13, 14 and 15 are first, second, third and fourth recovery steps, respectively, according to still another preferred embodiment of the present invention.

In the recovery operation, the first recovery step is initially performed in which ink droplets are ejected from the nozzles 43 corresponding to the first region C1 which is the outermost region on the first side in the ink chamber 22. This produces a horizontal flow of ink directed from the second side toward the first side in the ink chamber 22, as shown in FIG. 12.

Figure 13:
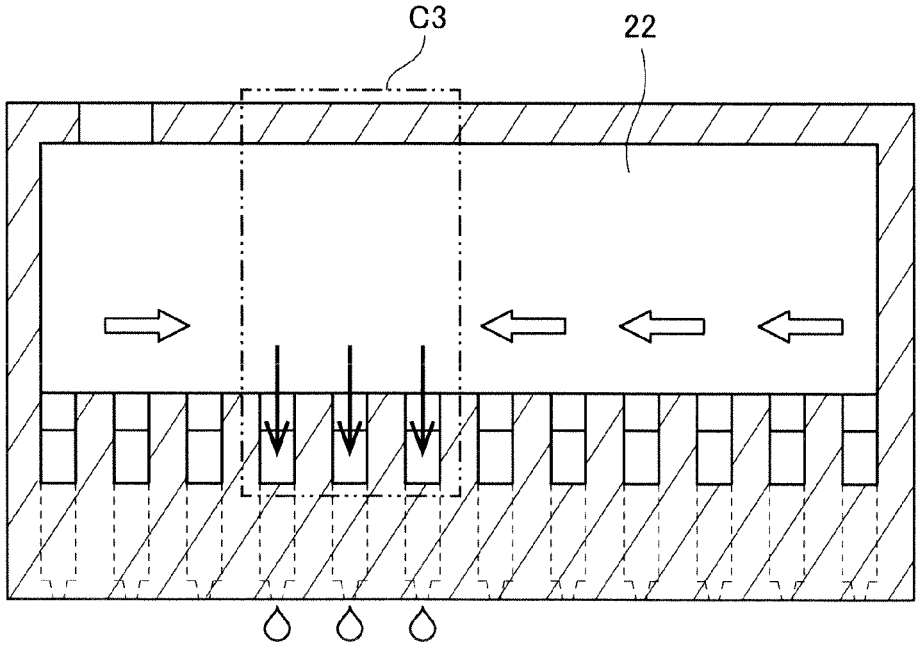

Next, the second recovery step is performed in which ink droplets are ejected from the nozzles 43 corresponding to the third region C3 which is closer to the second side in the ink chamber 22. This produces a horizontal flow of ink directed from the first side toward the second side in a region of the ink chamber 22 which is closer to the first side with respect to the middle of the ink chamber 22, as shown in FIG. 13.

Figure 14:
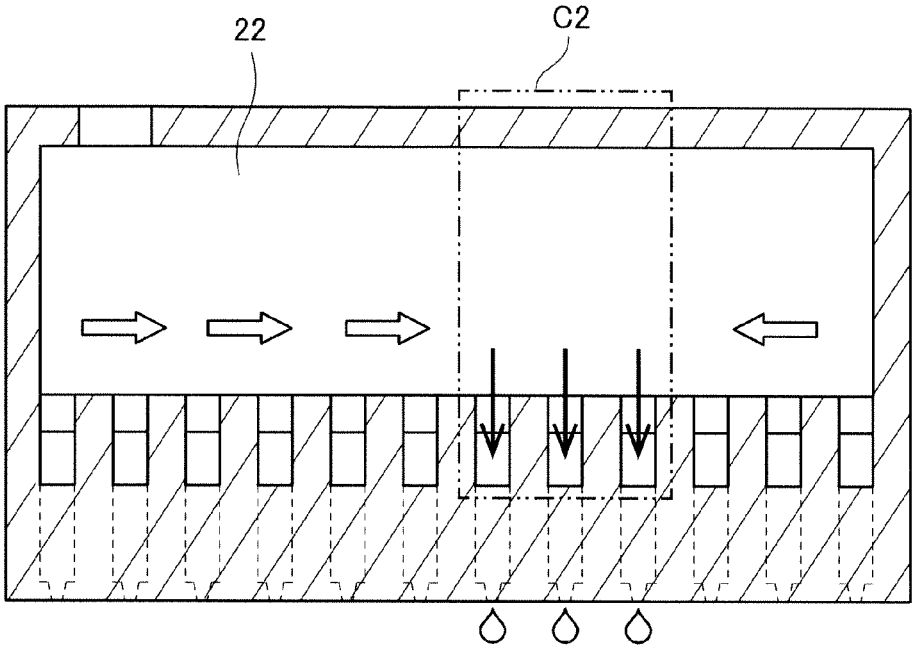

Subsequently, the third recovery step is performed in which ink droplets are ejected from the nozzles 43 corresponding to the second region C2 which is closer to the first side in the ink chamber 22. This produces a horizontal flow of ink directed from the second side toward the first side in a region of the ink chamber 22 which is closer to the second side with respect to the middle of the ink chamber 22, as shown in FIG. 14.

Figure 15:
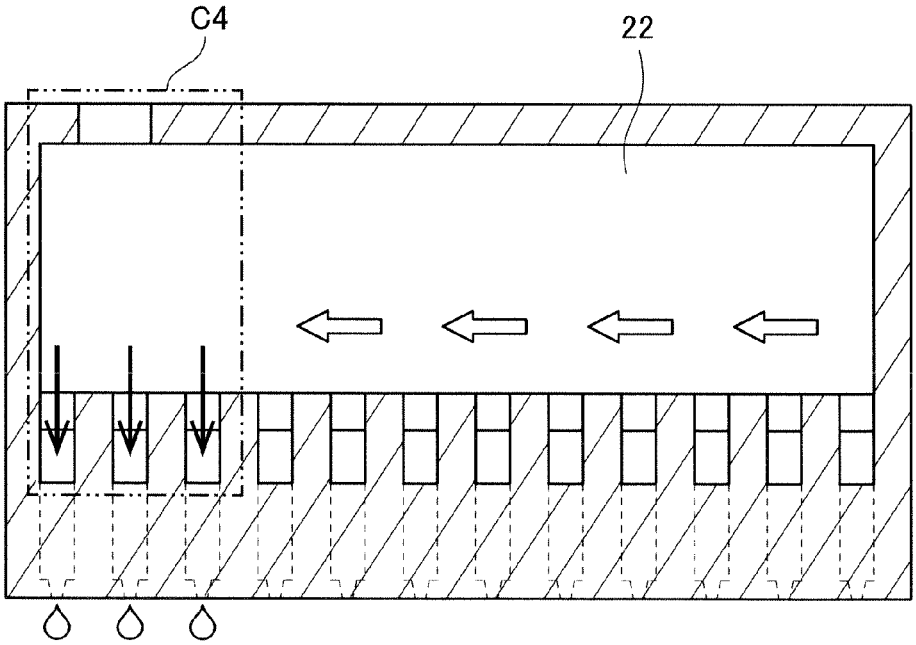

Finally, the fourth recovery step is performed in which ink droplets are ejected from the nozzles 43 corresponding to the fourth region C4 which is the outermost region on the second side in the ink chamber 22. This produces a horizontal flow of ink directed from the first side toward the second side in the ink chamber 22, as shown in FIG. 15.

In this manner, changes in the direction of the flow of ink in the ink chamber 22 in the first to fourth recovery steps are as follows: initially from the second side toward the first side; next from the first side toward the second side; then from the second side toward the first side; and finally from the first side toward the second side. This efficiently agitates the ink in the ink chamber 22 to efficiently disperse the precipitable ingredients 220 accumulating in the ink chamber 22. Also, the ejection of ink droplets from the nozzles 43 corresponding to the entire region in the ink chamber 22 eliminates the accumulation of the precipitable ingredients 220 in all of the pressure chambers 23 in communication with the ink chamber 22.

Although the three or four regions are set in the ink chamber 22 in the aforementioned preferred embodiment and the first and second variations, the present invention is not limited to this. The number of regions set in the ink chamber 22 may be two or not less than five.

The recovery operation of the aforementioned preferred embodiment, the recovery operation of the first variation, the recovery operation of the second variation, and the recovery operation of another variation may be performed in succession. These recovery operations may be performed in combination. This makes the best use of the advantages of the respective recovery operations to achieve the more efficient dispersion of the precipitable ingredients in the ink chamber 22.

3-2. Variations of Timing of Recovery Operation

Next, variations of the timing of the recovery operation will be described. The recovery operation of the aforementioned preferred embodiment is performed before the image recording step for recording an image pattern on the printing paper 9. In other words, the timing of the recovery operation of the aforementioned preferred embodiment corresponds to that of the conventional spitting. The present invention, however, is not limited to this.

<3-2-1. Recovery Operation Performed During Waiting Time Period>

The recovery operation may be performed during a waiting time period over which the image recording step for recording an image pattern on the printing paper 9 is not performed. For example, the recovery operation may be performed immediately after the turning-on of the power to the recording apparatus 1. Alternatively, the recovery operation may be performed automatically after a lapse of a predetermined time period since the turning-on of the power to the recording apparatus 1, since the completion of the preceding recovery operation or since the completion of the image recording step.

<3-2-2. Recovery Operation which Ejects Ink Toward Printing Paper>

Figure 16A:
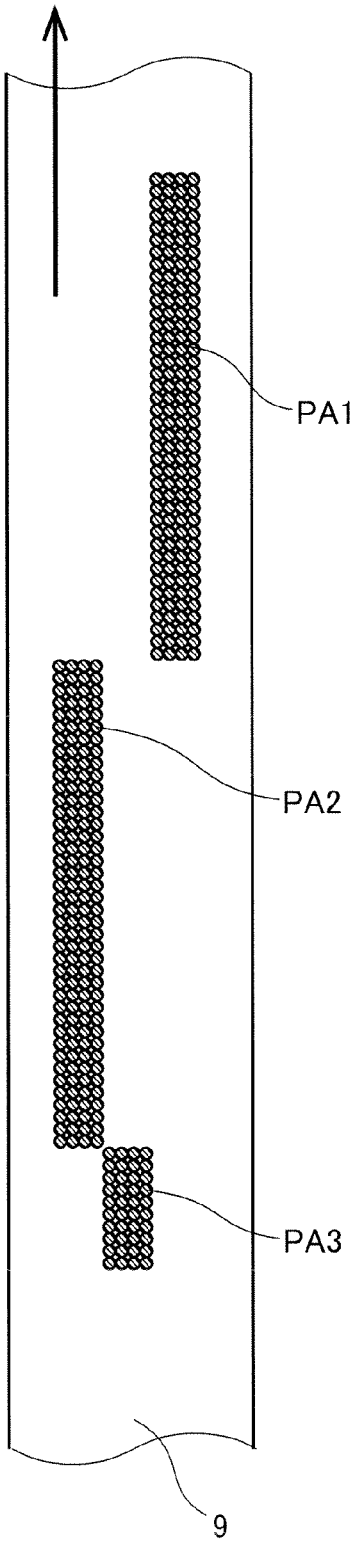
FIGS. 16A to 16C are views showing examples of a recovery operation pattern according to modifications of the present invention.
Figure 16B:
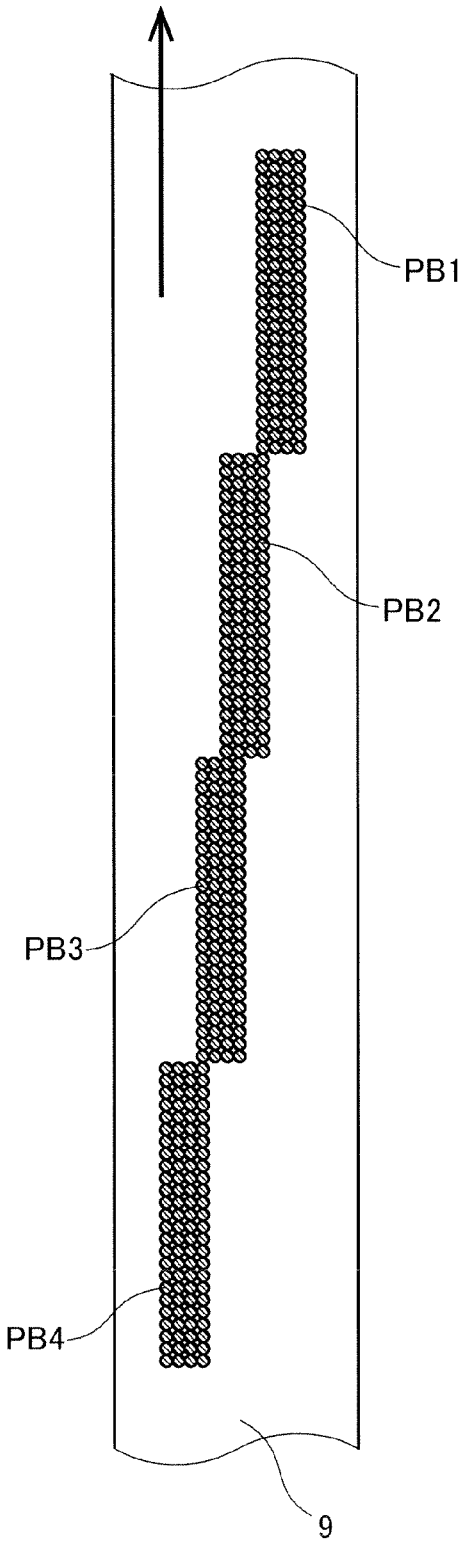
Figure 16C:
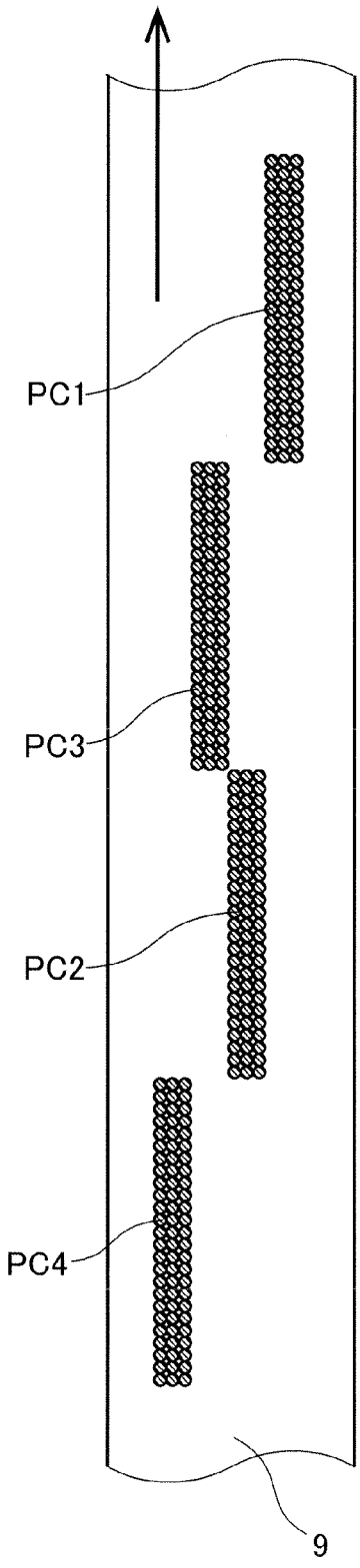

Although ink droplets are ejected toward the cap in the recovery operation of the aforementioned preferred embodiment, the present invention is not limited to this. In the recovery operation, ink droplets may be ejected toward the printing paper 9. FIGS. 16A to 16C are views showing examples of a recovery operation pattern recorded on the printing paper 9 by means of the recording head 20 schematically shown in FIG. 3.

When the elongated printing paper 9 is used as in the aforementioned preferred embodiment, a recording region in which an image pattern is to be recorded and a non-recording region in which no image pattern is to be recorded may be previously determined on the printing paper 9, so that the recovery operation is performed by recording a recovery operation pattern in the non-recording region.

The recovery controller 802 performs the recovery operation while transporting the printing paper 9, with the non-recording region of the printing paper 9 and the surface of the recording head 20 which has the nozzles 43 placed in mutually opposed positions by the transport mechanism 10. This causes ink droplets to be ejected into the non-recording region of the printing paper 9, so that the recovery operation patterns as shown in FIGS. 16A to 16C are recorded. It should be noted that the transport direction of the printing paper 9 is indicated by solid arrows in FIGS. 16A to 16C.

FIG. 16A shows a recovery operation pattern obtained when the recovery operation of the aforementioned preferred embodiment is performed on the printing paper 9. In FIGS. 16A to 16C, an upper part thereof corresponds to a downstream side as viewed in the transport direction of the printing paper 9, and a lower part thereof corresponds to an upstream side. In the example of FIG. 16A, ink droplets are initially ejected 40 times from the four nozzles 43 corresponding to the first region A1, so that a pattern PA1 is recorded on the most downstream side of the non-recording region of the printing paper 9 as viewed in the transport direction. Next, ink droplets are ejected 40 times from the four nozzles 43 corresponding to the second region A2, so that a pattern PA2 is recorded upstream from the pattern PA1 as viewed in the transport direction. Thereafter, ink droplets are ejected 10 times from the four nozzles 43 corresponding to the remaining region, so that a pattern PA3 is recorded upstream from the pattern PA2 as viewed in the transport direction.

FIG. 16B shows a recovery operation pattern obtained when the recovery operation of the aforementioned first variation is performed on the printing paper 9. In the example of FIG. 16B, ink droplets are initially ejected 25 times from the four nozzles 43 corresponding to the first region B1, so that a pattern PB1 is recorded on the most downstream side of the non-recording region of the printing paper 9 as viewed in the transport direction. Next, ink droplets are ejected 25 times from the four nozzles 43 corresponding to the second region B2, so that a pattern PB2 is recorded upstream from the pattern PB1 as viewed in the transport direction. Subsequently, ink droplets are ejected 25 times from the four nozzles 43 corresponding to the third region B3, so that a pattern PB3 is recorded upstream from the pattern PB2 as viewed in the transport direction. Thereafter, ink droplets are ejected 25 times from the four nozzles 43 corresponding to the fourth region B4, so that a pattern PB4 is recorded upstream from the pattern PB3 as viewed in the transport direction.

FIG. 16C shows a recovery operation pattern obtained when the recovery operation of the aforementioned second variation is performed on the printing paper 9. In the example of FIG. 16C, ink droplets are initially ejected 25 times from the three nozzles 43 corresponding to the first region C1, so that a pattern PC1 is recorded on the most downstream side of the non-recording region of the printing paper 9 as viewed in the transport direction. Next, ink droplets are ejected 25 times from the three nozzles 43 corresponding to the third region C3, so that a pattern PC3 is recorded upstream from the pattern PC1 as viewed in the transport direction. Subsequently, ink droplets are ejected 25 times from the three nozzles 43 corresponding to the second region C2, so that a pattern PC2 is recorded upstream from the pattern PC3 as viewed in the transport direction. Thereafter, ink droplets are ejected 25 times from the three nozzles 43 corresponding to the fourth region C4, so that a pattern PC4 is recorded upstream from the pattern PC2 as viewed in the transport direction.

In this manner, the recovery operation may be performed by recording a predetermined recovery operation pattern on the printing paper 9. It should be noted that the regions may differ from each other in the number of times of ejection. In that case, the number of times of ejection in a predetermined region may be increased so that a flow of ink is produced in a region where the accumulation of the precipitable ingredients is especially prone to occur in the ink chamber 22.

The recording apparatus according to the present invention may be a sheet-fed recording apparatus. In that case, recording printing paper for recording an image pattern thereon and recovery printing paper for recording a recovery operation pattern thereon may be prepared.

3-3. Other Modifications

Although the cap 31 is moved between the two positions in the aforementioned preferred embodiment, the present invention is not limited to this. With the cap 31 at a fixed position, the recording head 20 may be moved between a standby position opposed to the cap 31 and a printing position opposed to the printing paper 9.

Although the regions in the ink chamber 22 are set with reference to the longitudinal position of the ink chamber 22 in the aforementioned preferred embodiment, the present invention is not limited to this. The regions in the ink chamber 22 may be set with reference to the transverse position of the ink chamber 22. The longitudinal and transverse positions of one of the regions may differ from those of another region.

In the aforementioned preferred embodiment, with the recording head 20 fixed in position, ink is ejected toward the printing paper 9 while the printing paper 9 is moved relative to the recording head 20. Instead, with the printing paper 9 fixed in position, the ejection of ink toward the printing paper 9 may be performed while the recording head 20 is moved relative to the printing paper 9. In other words, the second moving mechanism according to the present invention may be configured to move the recording medium and the ejecting head relative to each other.

In the aforementioned preferred embodiment, the size of the ink droplets ejected from the nozzles 43 may be selected from among the three types: large, medium and small sizes. However, the size of the ink droplets ejectable from the nozzles 43 may be of one or two types or of not less than four types.

The aforementioned recording apparatus 1 records an image on the printing paper 9 serving as a recording medium. However, the recording apparatus according to the present invention may be configured to record an image on a sheet-like recording medium other than general paper (for example, a film made of resin and the like).

The components described in the aforementioned preferred embodiment and in the modifications may be consistently combined together, as appropriate.

While the invention has been described in detail, the foregoing description is in all aspects illustrative and not restrictive. It is understood that numerous other modifications and variations can be devised without departing from the scope of the invention.

What is claimed is:

1. A droplet ejecting apparatus comprising:

a liquid filling chamber filled with a liquid;

pressure chambers in communication with said liquid filling chamber and filled with said liquid; and a recovery controller for controlling ejection of said liquid from said pressure chambers during a recovery operation for diffusing accumulation of precipitable ingredients in said pressure chambers, each of said pressure chambers including:

a communication port in communication with said liquid filling chamber;

a pressure generating element for exerting pressure on the liquid which fills an interior of each of said pressure chambers; and a nozzle for ejecting the liquid in each of said pressure chambers therefrom in a form of droplets, said liquid filling chamber including a plurality of partial regions within a certain range in a designated direction, the plurality of partial regions including a first partial region within a first range in the designated direction and a second partial region within a second range in said designated direction, each of the plurality of partial regions respectively corresponding to plural ones of said pressure chambers, said first partial region is located within a first half range while said liquid filling chamber is divided into half in said designated direction, said second partial region is located within a second half range while said liquid filling chamber is divided into half in said designated direction, said recovery controller bringing said pressure generating element corresponding to said communication port included in said first partial region of said liquid filling chamber into operation to cause said nozzle corresponding to said first partial region to eject said droplets, and said recovery controller causes said nozzle corresponding to said communication port included in said second partial region of said liquid filling chamber to eject said droplets just after said nozzle corresponding to said communication port included in said first partial region ejects said droplets.

2. The droplet ejecting apparatus according to claim 1, wherein said first partial region is an outermost region on a first side of said plurality of regions, and said second partial region is an outermost region on a second side of said plurality of regions.

3. The droplet ejecting apparatus according to claim 2, wherein the plurality of partial regions includes another partial region, said another partial region corresponding to all of said pressure chambers without said pressure chambers corresponding to said first partial region and said second partial region, and said recovery controller causes said nozzle corresponding to said communication port included in said another partial region of said liquid filling chamber to eject said droplets just after said nozzle corresponding to said communication port included in said second partial region ejects said droplets.

4. The droplet ejecting apparatus according to claim 1, further comprising:

an ejecting head including said liquid filling chamber and said pressure chambers;

a cap opposed to a surface of said ejecting head which has said nozzles; and a first moving mechanism for moving said cap and said ejecting head relative to each other, said recovery controller causing said nozzle corresponding to said communication port included in said first partial region of said liquid filling chamber to eject said droplets, with said cap and the surface of said ejecting head which has said nozzles placed in mutually opposed positions by said first moving mechanism.

5. The droplet ejecting apparatus according to claim 1, further comprising:

an ejecting head including said liquid filling chamber and said pressure chambers; and a second moving mechanism for moving a recording medium and said ejecting head relative to each other, said recovery controller causing said nozzle corresponding to said communication port included in said first partial region of said liquid filling chamber to eject said droplets, with a non-recording region of said recording medium and the surface of said ejecting head which has said nozzles placed in mutually opposed positions by said second moving mechanism.

6. The droplet ejecting apparatus according to claim 1, wherein said droplets ejected from said nozzles are selectable from among said droplets of at least two types of liquid volumes including large and small sizes, and said recovery controller causes said nozzle corresponding to said communication port included in said first partial region to eject said droplets of said large size.

7. The droplet ejecting apparatus according to claim 1, wherein said designated direction is a longitudinal direction of said liquid filling chamber.

8. The droplet ejecting apparatus according to claim 1, wherein the plurality of partial regions includes a third partial region within a third range in a designated direction, said third partial region is located within said first half range, and said recovery controller causes said nozzle corresponding to said communication port included in said third partial region of said liquid filling chamber to eject said droplets just after said nozzle corresponding to said communication port included in said second partial region ejects said droplets.

9. The droplet ejecting apparatus according to claim 8, wherein the plurality of partial regions includes a fourth partial region within a fourth range in a designated direction, said fourth partial region being located within said second half range, and said recovery controller causes said nozzle corresponding to said communication port included in said fourth partial region of said liquid filling chamber to eject said droplets just after said nozzle corresponding to said communication port included in said third partial region ejects said droplets.

10. A method of ejecting droplets in a droplet ejecting apparatus including a liquid filling chamber filled with a liquid and pressure chambers each having a communication port in communication with said liquid filling chamber, said liquid being ejected in a form of droplets from a nozzle provided in each of said pressure chambers, said liquid filling chamber including a plurality of partial regions within a certain range in a designated direction, the plurality of partial regions including a first partial region within a first range in the designated direction and a second partial region within a second range in said designated direction, each of the plurality of partial regions respectively corresponding to plural ones of said pressure chambers, said first partial region being located within a first half range while said liquid filling chamber is divided into half in said designated direction, and said second partial region being located within a second half range while said liquid filling chamber is divided into half in said designated direction, said method comprising:

a) performing a recovery operation of ejecting said droplets from said nozzle corresponding to said communication port included in said first partial region of said liquid filling chamber; and b) performing the recovery operation of ejecting said droplets from said nozzle corresponding to said communication port included in said second partial region of said liquid filling chamber, said step b) being performed just after said step a).

11. The method according claim 10, wherein an entirety of said recovery operation is performed at predetermined time intervals.

12. The method according to claim 10, wherein said first partial region is an outermost region on a first side of said plurality of regions, and said second partial region is an outermost region on a second side of said plurality of regions.

13. The method according to claim 12, wherein:

the plurality of partial regions includes another partial region, said another partial region corresponding to all of said pressure chambers without said pressure chambers corresponding to said first partial region and said second partial region, and the method further comprises:

c) performing the recovery operation of ejecting said droplets from said nozzle corresponding to said communication port included in said another partial region of said liquid filling chamber, said step c) being performed just after said step b).

14. The method according to claim 10, wherein said recovery operation is performed on a cap placed in opposed relation to said nozzles.

15. The method according to claim 10, wherein said recovery operation is performed on a non-recording region of a recording medium placed in opposed relation to said nozzles.

16. The method according to claim 10, wherein said recovery operation is performed at predetermined time intervals.

17. The method according to claim 10, further comprising the step of c) ejecting said droplets from said nozzles toward a recording region of a recording medium to record an image on the recording region of said recording medium, said recovery operation being performed before said step c).

18. The method according to claim 10, wherein said droplets ejected from said nozzles are selectable from among said droplets of at least two types of liquid volumes including large and small sizes, and said droplets of said large size are ejected from said nozzle corresponding to said communication port included in said first partial region in said recovery operation.

19. The method according to claim 10, wherein said designated direction is a longitudinal direction of said liquid filling chamber.

20. The method according to claim 10, wherein, during an entirety of said recovery operation, only some of, not all, nozzles eject said droplet simultaneously.

21. The method according to claim 10, wherein:

the plurality of partial regions includes a third partial region within a third range in a designated direction, said third partial region being located within said first half range, and the method further comprises:

c) performing the recovery operation of ejecting said droplets from said nozzle corresponding to said communication port included in said third partial region of said liquid filling chamber, said step c) being performed just after said step b).

22. The method according to claim 21, wherein:

the plurality of partial regions includes a fourth partial region within a fourth range in a designated direction, said fourth partial region being located within said second half range, and the method further comprises the step of:

d) performing the recovery operation of ejecting said droplets from said nozzle corresponding to said communication port included in said fourth partial region of said liquid filling chamber, said step d) being performed just after said step c).

* * * * *